United States Patent [19]

Yang

[11] Patent Number: 4,794,713

[45] Date of Patent: Jan. 3, 1989

[54] COMBINATION OF ALBUM AND PICTURE FRAME

[76] Inventor: M. F. Yang, 4, Alley 15, Lane 526, Section 2, Chung-Shan Road, Chung-Ho, Taipei Hsien, Taiwan

[21] Appl. No.: 81,775

[22] Filed: Aug. 5, 1987

[51] Int. Cl.[4] ..... A47G 1/06; G09F 1/12

[52] U.S. Cl. ..... 40/152.1; 40/388

[58] Field of Search ..... 40/152, 152.1, 155, 40/530, 388; 220/339; 206/311, 312, 372, 373, 451, 455, 456, 481, 45.34, 402, 425

[56] References Cited

U.S. PATENT DOCUMENTS

| | | | |
|---|---|---|---|
| 2,463,450 | 3/1949 | Wisner | 40/530 |
| 2,850,294 | 9/1958 | Ortis et al. | 40/530 |
| 3,136,082 | 6/1964 | Sloves | 40/530 |
| 3,589,049 | 6/1971 | Cornelius | 40/152 |
| 4,164,085 | 8/1979 | Steeb et al. | 40/152 |
| 4,255,872 | 3/1981 | Williams, Sr. | 220/339 |
| 4,655,342 | 4/1987 | Brauner et al. | 220/339 |

*Primary Examiner*—Robert Peshock
*Assistant Examiner*—Michael Lynch
*Attorney, Agent, or Firm*—Angelo Notaro

[57] ABSTRACT

A combination of album and picture frame comprises a cover or case having a transparent part or window at the top, a plurality of loose leaves for mounting pictures, and a binding device having a socket and support fixed in an appropriate place of the bottom of the cover and a ball-ended column with wire rings is provided for securing the loose leaves, so that the combination can be used as an album and picture frame to collect and display pictures.

2 Claims, 1 Drawing Sheet

COMBINATION OF ALBUM AND PICTURE FRAME

BACKGROUND AND SUMMARY OF THE INVENTION

Conventional albums now available are of the bound or loose-leaf book type with blank pages for mounting pictures or collecting autographs without the function of displaying pictures like a picture frame. To display fine works (photographs) the user of an album must buy separate picture frames. It also takes time to replace a picture in a picture frame which thus can not display pictures in series.

In view of the above mentioned disadvantages, the inventor tried hard to make improvements and developed this invention.

So the main object of this invention is to provide a combination of album and picture frame which can be used to collect and display pictures as an album and picture frame.

Another object of this invention is to provide a combination of album and picture frame which has a binding device for the easy removal, rearrangement, or replacement of leaves.

DETAILED DESCRIPTION OF THE PREFERRED EMBODIMENT

Figure 1:
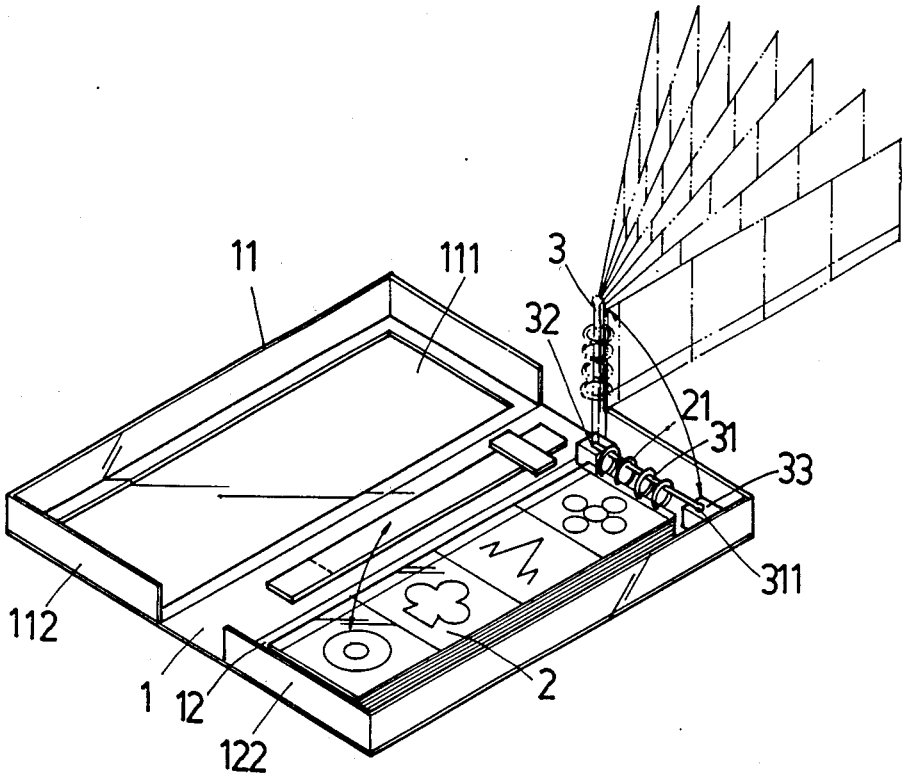
FIG. 1 illustrates the construction of the combination of album and picture frame of this invention.

Referring now to the Drawings, the nature of this invention is described as follows:

As shown in FIG. 1, the combination of album and picture frame comprises a cover or, case 1, a plurality of loose leaves 2 and a binding device 3.

The case or cover 1 has a winding 111 in its front wall 11, a socket 32 and support 121 at the inside of its rear wall 12, and projections or end wall 112, 122 at the edges of both the front and rear wall 11, 12 to form a case for containing a number of loose leaves 2.

The leaves 2 are secured together by a number of wire rings 21 of the binding device 3 in the cover 1. In addition to the wire rings 21, the binding device 3 consists of a ball-ended column 31, a socket 32 fixed in an appropriate place, e.g., near a corner of the rear wall 12 of the cover 1 to form a ball and socket joint with the column 31, and a support 33 fixed in an appropriate place, e.g., near an opposite corner of the same to support the free end 311 of the column 31.

After the loose leaves 2 with pictures mounted thereon are secured together by the binding device 3 and the free end 311 of the column 31 is put on the support 33, the front wall 11 of the cover 1 can be closed and the pictures can be seen through the window 111. And with a leg 121, the cover 1 with pictures set in it can stand and be used as a picture frame for displaying the pictures on the top page.

Figure 2:
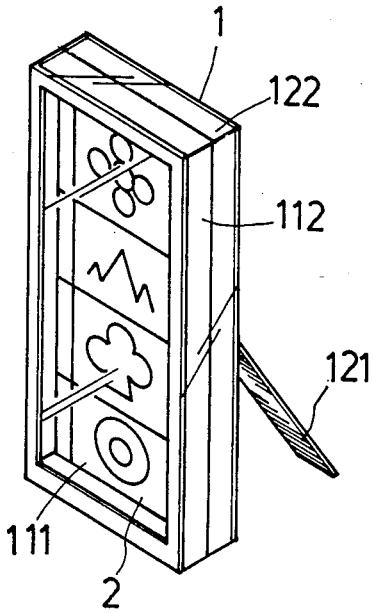
FIG. 2 illustrates the application of the said combination.

To change the displayed pictures, the cover 1 is opened, the free end 311 of the column 31 is pulled off the support 33 to allow the column 31 to stand on the socket 32 as shown in FIG. 2 and the leaves can be turned and rearranged so that the desired pictures are on the top for displaying after the free end 311 of the column 31 is put back on the support 33 and the cover is closed.

As shown in FIGS. 1 and 2, the rear wall is pivotally mounted to the front wall. Both front and rear walls 11, 12, have end and side walls, so that when the front and rear walls are pivoted over each other, as shown in FIG. 2, they define a closed space.

Thus, the combination of album and picture frame of this invention can be used for collecting and displaying pictures or photos and is more convenient in changing display pictures than any conventional picture frame.

I claim:

1. A combination album and picture frame comprising:

a rear wall having end and side walls;

a front wall having a transparent window therein, said front wall having end and side walls, and being pivotable over said rear wall for forming a case defining an interior space;

a socket joint connected to said rear wall in said case;

a column having a ball end pivotally mounted in said socket joint, said column having an opposite end;

a support connected to said rear wall in said case and spaced away from said socket joint, said column being pivotally connected to said socket joint for movement between a first position with said opposite end of said column engaged with said support and said column extending between said socket joint and said support, and a second position extending away from said rear wall with said front wall pivoted away from said rear wall to open said case;

a plurality of loose-leaves, each for receiving at least one picture and being of a size so as to fit within said case; and a plurality of wire rings binding said plurality of loose-leaves together, said wire rings being engaged onto said column with said column in its first and second positions, whereby with said column in its first position, said plurality of loose-leaves lie flat inside said case with one of said loose-leaves being uppermost and being visible through said window and with said column in its second position, said loose-leaves being pivotable about said wire rings and said column for changing the uppermost loose-leaf.

2. A combination album and picture frame according to claim 1, wherein said case is rectangular and has an upper edge, said column in its first position extending parallel to and near said upper edge of said case.

* * * * *